US009302166B2

(12) United States Patent
Annapragada

(10) Patent No.: US 9,302,166 B2
(45) Date of Patent: Apr. 5, 2016

(54) TENNIS BACKBOARD FOR EXCELLENT REBOUND AND LOW NOISE

(71) Applicant: Sai Karthik Annapragada, Union City, CA (US)

(72) Inventor: Sai Karthik Annapragada, Union City, CA (US)

( * ) Notice: Subject to any disclaimer, the term of this patent is extended or adjusted under 35 U.S.C. 154(b) by 0 days.

(21) Appl. No.: 14/151,779

(22) Filed: Jan. 9, 2014

(65) Prior Publication Data

US 2015/0190701 A1 Jul. 9, 2015

(51) Int. Cl.
*A63B 69/00* (2006.01)

(52) U.S. Cl.
CPC ..... *A63B 69/0097* (2013.01); *A63B 2102/02* (2013.01); *A63B 2209/00* (2013.01)

(58) Field of Classification Search
CPC . A63B 69/00; A63B 69/0002; A63B 69/0097
USPC ..... 473/422, 434, 435, 446, 451, 454
See application file for complete search history.

(56) References Cited

U.S. PATENT DOCUMENTS 1,175,692 A * 3/1916 Boicourt ..... 273/378
1,567,384 A * 12/1925 Rectenwald ..... A63B 69/0097 473/456
2,104,375 A * 1/1938 Perry ..... 273/148 R
3,001,790 A * 9/1961 Pratt ..... A63B 9/0097 473/434
3,062,669 A * 11/1962 Dilnot ..... C04B 28/18 106/672
3,516,675 A * 6/1970 Gregory et al. ..... 473/164
4,093,218 A * 6/1978 Burchers ..... 473/435
D265,413 S * 7/1982 Millikan ..... D21/799.1
4,344,621 A * 8/1982 Baker ..... 473/446
4,373,720 A * 2/1983 Lombardi ..... A63B 69/0097 473/434
4,415,154 A * 11/1983 Engelhardt ..... 473/456
4,491,321 A * 1/1985 Veenema ..... A63B 69/0097 472/92
4,588,190 A * 5/1986 Stewart ..... A63B 69/0097 473/435
5,007,638 A * 4/1991 Yukl ..... 473/435
5,354,051 A * 10/1994 Fehrenbach et al. ..... 473/434
5,795,252 A * 8/1998 Crucet ..... A63B 71/022 473/434
5,934,679 A * 8/1999 Strain et al. ..... 473/435
5,993,334 A * 11/1999 McNamara ..... 473/446
6,010,414 A * 1/2000 Snow ..... 473/422
6,213,900 B1 * 4/2001 Steyn et al. ..... A63B 69/0097 473/415
6,250,634 B1 * 6/2001 Strain et al. ..... 473/435
6,554,284 B2 * 4/2003 Chou ..... 473/451
6,837,809 B2 * 1/2005 Majumdar ..... 473/454
7,201,675 B2 * 4/2007 Morrison ..... A63B 69/0097 473/434
7,249,767 B1 * 7/2007 Gorton ..... 473/434
7,677,993 B2 * 3/2010 McTavish ..... A63B 69/0097 473/434
2004/0023735 A1 * 2/2004 Janton ..... 473/434
2005/0049088 A1 * 3/2005 Chang et al. ..... 473/434
2013/0344998 A1 * 12/2013 Adema ..... 473/435
2015/0190701 A1 * 7/2015 Annapragada ..... A63B 69/0097 473/435

FOREIGN PATENT DOCUMENTS

AU 9470211 A * 2/1995 ..... A63B 71/04
GB 2450759 A * 1/2009 ..... A63B 69/00

* cited by examiner

*Primary Examiner* — Mitra Aryanpour

(57) ABSTRACT

A tennis practice device that has a rebound surface made out of composite material consisting of cement, ground calcium silica, cellulose fibers, wood fibers and other select additives such as fly ash and a sound dampening material sandwiched between the rebound surface and the support structure.

6 Claims, 3 Drawing Sheets

TENNIS BACKBOARD FOR EXCELLENT REBOUND AND LOW NOISE

CROSS-REFERENCE TO RELATED APPLICATIONS

USPTO Application No. 61/751,400, Filing or 371(c) Date: Jan. 11, 2013

STATEMENT REGARDING FEDERALLY SPONSORED RESEARCH OR DEVELOPMENT

Not Applicable

BACKGROUND OF THE INVENTION

The present invention is in the technical filed of tennis practice boards or tennis backboards.

Tennis backboards enable tennis players to practice and improve their tennis playing skills using vertical or slanted surfaces. These tennis backboards are typically mounted to a chain fence surrounding the tennis court and tend to be very large. Some large tennis walls are also built using concrete near tennis courts. There are also portable tennis backboards available for use in the backyards or driveways. These portable tennis practice devices use a plastic or nylon net to rebound the tennis ball while a few other tennis practice devices use a flexible plastic sheet mounted on metal tubes to rebound the ball. All these devices have several disadvantages. The tennis boards mounted on fences tend to be very large and expensive and not suitable for home practice. Portable plastic net and flexible plastic sheet based practice devices have poor rebound capability. The prior art materials used for tennis ball rebound surface are plywood, wood, oriented strand board (OSB), plastic all of which have several disadvantages. Plywood, wood and oriented strand board tend to crack and warp when subjected to the elements due to high expansion and contraction due to changes in weather. Cracked and warped surfaces are not suitable for tennis ball rebound. In addition, these materials rot over a period of time. Plastic materials used for tennis backboards result in very high noise and are very expensive. Paint does not adhere well to plastic materials if they need to be painted. All these materials require very expensive way of reducing the noise from tennis ball hitting the surface such as filling the rebound unit with sand or water etc.

The present invention overcomes all the major disadvantages or the prior art tennis practice devices such as poor tennis ball rebound capability, cracking, warping and rotting of the rebound surfaces, high noise levels, high cost of noise reduction, high cost of materials used.

SUMMARY OF THE INVENTION

The present invention is a tennis practice device that enables excellent tennis ball rebound with very low noise while being economical to build and long lasting. These backboards can be portable for use indoors or in backyards or on or around tennis courts. The larger versions of these can be mounted on metal fences surrounding the tennis courts. Or these backboards can be built as permanent structures as an alternative to building concrete tennis practice walls as the backboards described in this invention are very economical.

DETAILED DESCRIPTION OF THE INVENTION

Figure 1:
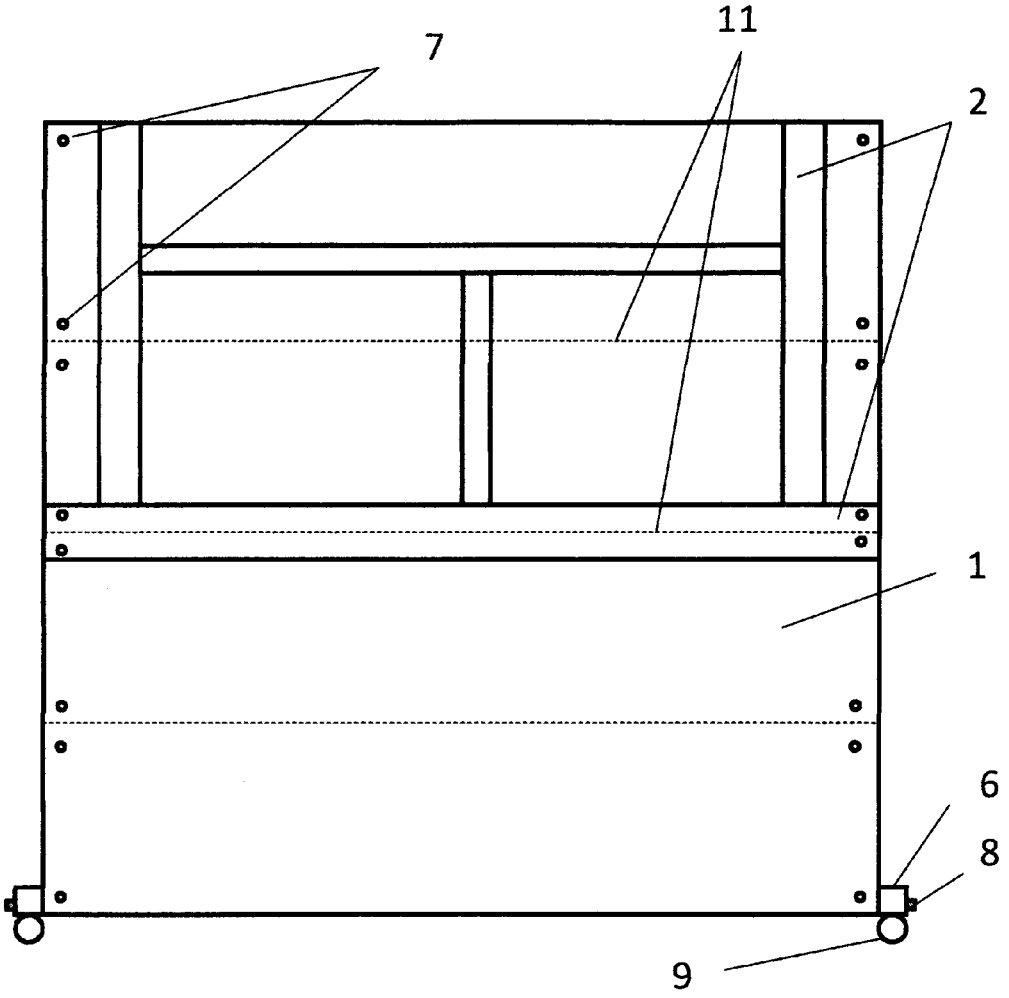
FIG. 1 is a front view of a tennis practice device of the present invention.
Figure 2:
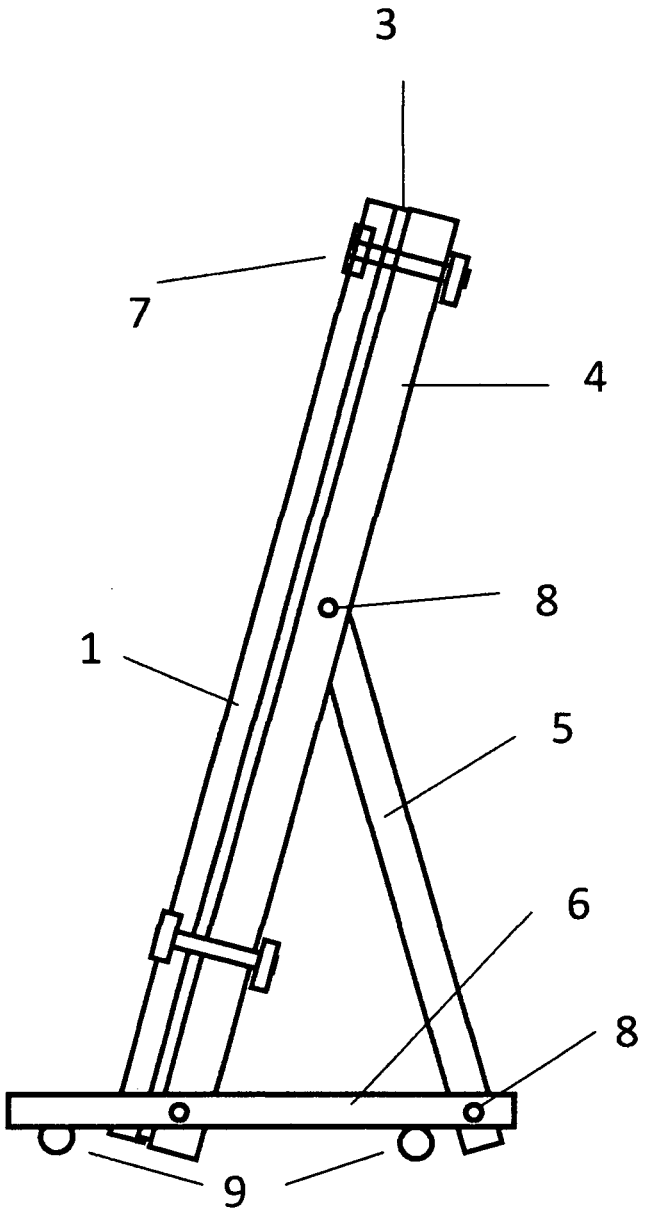
FIG. 2 is a side view of a tennis practice device of the present invention.
Figure 3:
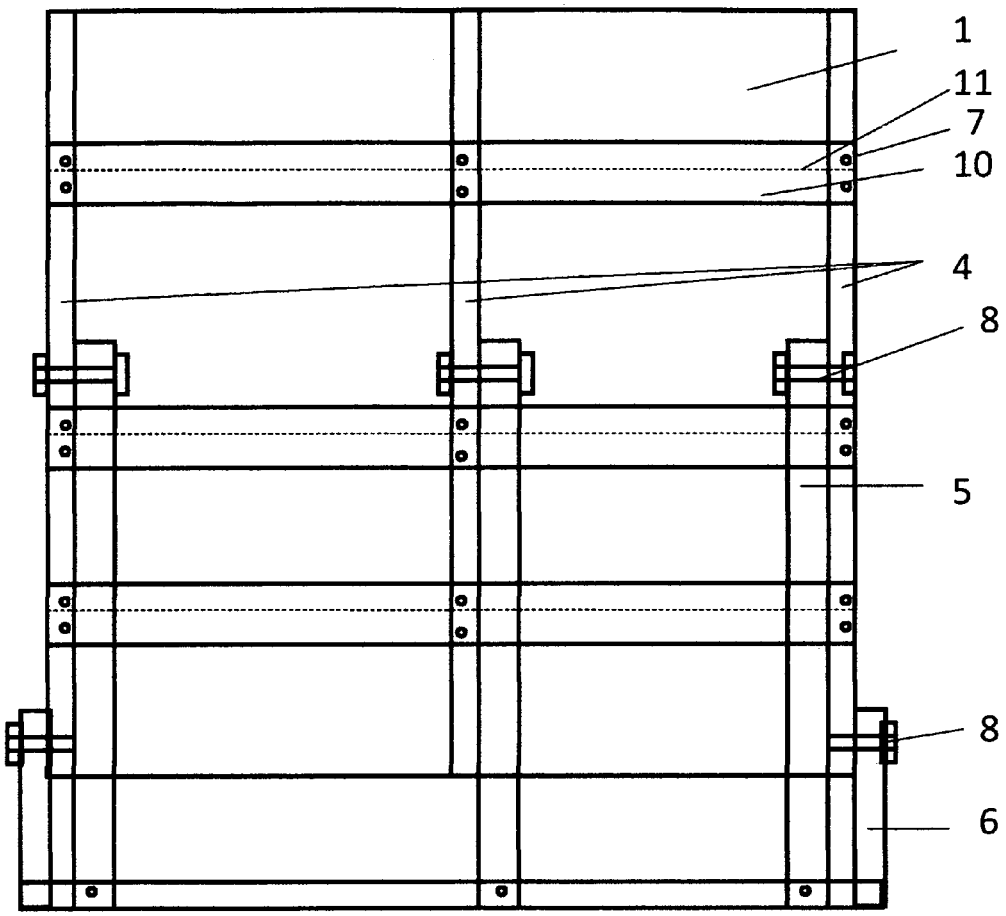
FIG. 3 is a rear view of a tennis practice device of the present invention.

Referring now to the invention in more detail, in FIG. 1, FIG. 2 and FIG. 3 a tennis practice device is shown. The tennis ball rebound sheet 1 of this device is made of a composite material made out of cement, ground calcium silica (ground sand), cellulose and/or wood fibers, and other select additives such as fly ash. Cellulose and/or wood fibers compromise as little as 10-15 percent of the composition of fiber cement. Cellulose and/or wood fibers prevents the siding from buckling and cracking under environmental stress caused by changes in weather. The composition of the material consists of approximately equal parts of cement and, ground calcium silica (ground sand). By varying the proportion of cement and, ground calcium silica (ground sand) the density of the material can be varied. Characteristics of this material such as high density compared to other materials used in prior art, such as plywood, oriented strand board, plastic, wood etc. offers several advantages for tennis backboards. The high density of the material leads to excellent tennis ball rebound capability and low noise even when the sheet is thinner than 1 inch. In addition the material will not rot, swell or warp even when subjected to the elements rain, snow, wind, sun etc. The material does not contract and expand when subjected to the environmental stress caused by changes in weather unlike the prior art materials plywood, oriented strand board and wood. Paint adheres very well to this material and the paint will not peel or crack as the material does not expand and contract. In addition to all the advantages of this material mentioned above, the material is quite inexpensive so the tennis practice devices made out of this material become affordable to a large number of people enabling to them to practice tennis at home and improve their tennis game.

While this device is designed for use outdoors to withstand the elements, the device can also be used indoors. This sheet can be of any thickness ranging from 0.01 inches to 1 inches, more preferably ¼ inch to ¾ inch thickness. This sheet can be of 4 to 20 feet wide preferably 5 to 16 feet wide. The height can be from 5 feet to 12 feet, preferably 8 feet. The sheet is primed and painted using commercially available exterior grade primers and paints both on the front, back and the sides to prevent any deterioration of the sheet from water, wind and such. The sheet is further painted or taped using commercially available exterior grade tapes to form lines 2 in FIG. 1 to visually represent a tennis court.

In FIG. 2, the rebound sheet 1 is shown attached to a support structure 4 using fasteners 7. The support structures 4 can be made out of wood, metal, plastic or other material strong enough to support the rebound sheet and the force from the tennis ball hitting the rebound sheet. They may or may not be painted, though they are preferably painted using exterior grade paints.

Further in FIG. 2, in between the rebound sheet 1 and the support structure 4 is shown sound dampening device 3. The sound dampening device 3 is made out of soft rubber such as neoprene, EPDM or soft plastic material such as soft poly vinyl chloride, soft polyurethane, soft polyethylene or other suitable soft foam plastic or rubber material. The sound dampening device combines shock absorption, vibration damping and vibration isolation. In the figure it is shown as a continuous layer, but can be made in the form of spacers between the rebound sheet 1 and the support structure 4.

These soft materials absorb and isolate the vibrations of the rebound sheet caused by the tennis ball hitting the surface and thus significantly reduce the noise. The soft material is mounted on the support structures 4 at the back of the rebound sheet at close spacing of about 1 ft apart to be very effective in reducing vibrations and noise. In addition, the sound dampening device prevents the rebound sheet 1 from hitting the support structure 4 further reducing the noise caused by these two hard surfaces hitting against each other when the tennis ball hits the rebound sheet. This inexpensive method of sound reduction is very effective compared to prior art methods where very expensive methods of reducing the noise were used such as filling the rebound unit with water, sand etc.

In further detail, the fasteners 7 are mounted flush to the rebound sheet surface and are made from exterior grade metal fasteners. The fasteners can be painted the same color as the rebound sheet.

In further detail, the rebound sheet and the support structure are shown tilted with reference to the ground. The tilt can range from 0 degrees to 45 degrees preferably 15 degrees. The tilt enables the ball to be rebound to a larger distance to enable more realistic tennis practice.

In further detail, the tennis rebound sheet 1 and support structure 4 are further attached to structures 5 to support the rebound sheet and the support structure 4. Similar to support structures 4, support structures 5 can be made out of wood, metal, plastic or other suitable string material. This may or may not be painted, though they are preferably painted using exterior grade paints.

In further detail, the support structure 6 is used to connect the support structure 4 using fasteners 8. The support structure 4 can be more than one piece, preferably 3 pieces two on the sides of the rebound sheet 1 and one in the middle for a typical 5 foot width of the rebound sheet. The support structures 6 have casters 9 mounted on them for ease of moving the tennis practice device around. The casters may or may not have locking device. It is preferable to have locking devices to keep the tennis practice device in place to prevent moving while practicing.

In FIG. 3, the rear view of the present invention, the support structure 4 is shown in more detail with three pieces supporting the rebound sheet 1. Similarly support structure 5 is shown as three pieces connecting to the three support structures 4 using fasteners 8. In further detail, rebound sheet is 1 shown as four pieces and line 11 represents the place where the individual pieces of rebound sheet 1 are joined with each other using support structure 10 and fasteners 7. There is a fastener 7 on either side of the support structure 10. The fasteners 7 are tightened such a way that the pieces of the rebound sheet are flush with each other. Due to the flexibility of the sound dampening device 3, tightening the fasteners 7 by different amounts results in flush rebound surfaces 1. Multiple pieces of rebound sheet 1 enable ease of shipping and handling the product due to smaller size of the pieces rather than one single piece of the whole rebound sheet 1. In addition, smaller sizes of these sheets limit the vibration of the sheet resulting from the tennis ball hitting the sheet to these smaller sections rather than to the entire large sheet. Reduction of these vibrations results in reduced noise from the ball hitting the rebound surface.

What is claimed:

1. A tennis practice device comprising:

a planar backing panel;

a tennis rebound panel formed of a material consisting essentially of cement, ground calcium silica, cellulose fibers, wood fibers and fly ash;

a sound dampening layer sandwiched between the planar backing panel and the rebound panel, wherein the sound dampening layer is formed from a soft rubber material;

means for securing the planar backing panel, the sound dampening layer and rebound panel together; and a support stand for adjustably supporting the tennis practice device at an angle with respect to the support surface.

2. The tennis practice device of claim 1, wherein the thickness of the rebound panel ranges from 0.01 to 1 inch.

3. The tennis practice device of claim 1, wherein the width of the rebound panel ranges from 4 to 20 feet.

4. The tennis practice device of claim 1, wherein the height of the rebound panel ranges from 5 to 12 feet.

5. The tennis practice device of claim 1, wherein the rebound panel is painted using exterior grade paint on the front, back and the sides.

6. The tennis practice device of claim 1, wherein the rebound panel is painted using exterior grade paint or taped using exterior grade tape to form lines to visually represent a tennis court.

* * * * *